United States Patent [19]

Hashimoto

[11] Patent Number: 4,550,253

[45] Date of Patent: Oct. 29, 1985

[54] CORONA CHARGER OF SCOROTRON TYPE

[75] Inventor: Tatsutoshi Hashimoto, Hachioji, Japan

[73] Assignee: Olympus Optical Company Limited, Tokyo, Japan

[21] Appl. No.: 486,020

[22] Filed: Apr. 18, 1983

[30] Foreign Application Priority Data

Apr. 20, 1982 [JP] Japan ..... 57-57265

[51] Int. Cl.[4] ..... H01T 19/00; G03G 15/02

[52] U.S. Cl. ..... 250/326; 250/324; 355/3 CH; 361/229; 361/230

[58] Field of Search ..... 250/324, 325, 326; 355/3 CH; 361/229, 230

[56] References Cited

U.S. PATENT DOCUMENTS 3,936,635 2/1976 Clark ..... 250/325

4,358,681 11/1982 Ando ..... 250/324

*Primary Examiner*—Alfred E. Smith

*Assistant Examiner*—Jack I. Berman

*Attorney, Agent, or Firm*—Fleit, Jacobson, Cohn & Price

[57] ABSTRACT

In a corona charger of the scorotron type, a corona wire is detachably secured to a base frame made of insulating material and a control grid is also detachably secured to a grid frame made of insulating material. The grid frame is secured to the base frame in an easily removable manner. The control grid is resiliently stretched over an opening of the grid frame by means of a coiled spring. The corona wire can be easily cleaned or replaced without removing the control grid from the grid frame, and the control grid can be also simply cleaned or replaced without removing the corona wire from the base frame.

13 Claims, 3 Drawing Figures

CORONA CHARGER OF SCOROTRON TYPE

BACKGROUND OF THE INVENTION

The present invention relates to a corona charger and, more particularly, to a corona charger of the scorotron type having a corona wire and a control grid.

In a corona charger of the scorotron type, it is possible to control the maximum amount of electrification by adjusting a voltage applied to a control grid. In an electrophotographic machine, a corona charger of the scorotron type is widely used for uniformly charging a photosensitive member prior to the formation of an electrostatic latent image, and for uniformly charging the rear surface of a record paper prior to the transfer of a toner image to the record paper. In a known corona charger of the scorotron type, the corona wire for generating a corona discharge is directly secured to a base frame to which is also fixed a control grid. Therefore, it is quite difficult to replace the corona wire and control grid by new ones and to clean them. For instance, if one wishes to clean the corona wire, he must first remove the control grid from the base frame and this operation requires great care and a long time, because usually the control grid is very thin and can easily be broken. Moreover, since the corona wire and the control grid are secured to the common base frame, if the thermal expansion of the base frame, corona wire and control grid are different from each other, the corona wire and/or control grid might become loose or cut, and the desired charging function could no longer be effected.

SUMMARY OF THE INVENTION

The present invention has for its object to provide a novel and useful corona charger of the scorotron type in which a corona wire and a control grid can be replaced by new ones in an easy and rapid manner.

It is another object of the invention to provide a corona charger of the scorotron type in which the corona wire and control grid can be easily cleaned.

It is still another object of the invention to provide a corona charger of the scorotron type in which the influence of differences in thermal expansion between the corona wire, control grid and frame can be materially reduced.

According to the invention, a corona charger of the scorotron type comprises a base frame, a corona wire secured to the base frame, a grid frame detachably secured to the base frame, and a control grid secured to the grid frame.

In a preferred embodiment of the corona charger according to the invention, the corona wire and control grid are detachably secured to the base frame and grid frame, respectively.

DETAILED DESCRIPTION OF THE PREFERRED EMBODIMENTS

Figure 1:
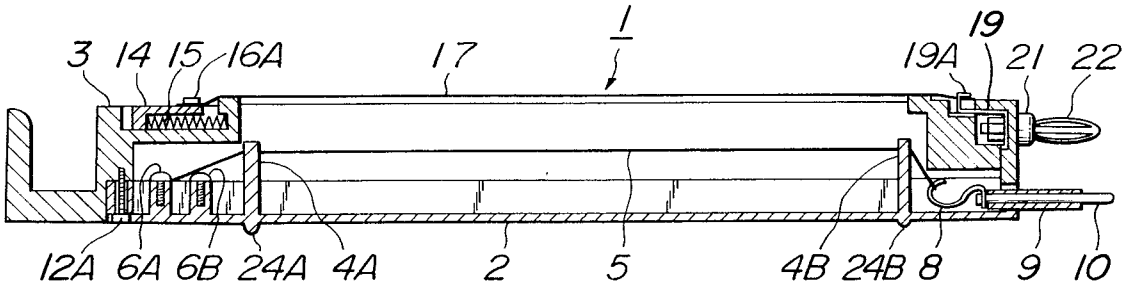
FIG. 1 is a longitudinal cross section showing an embodiment of the corona charger according to the invention.
Figure 2:
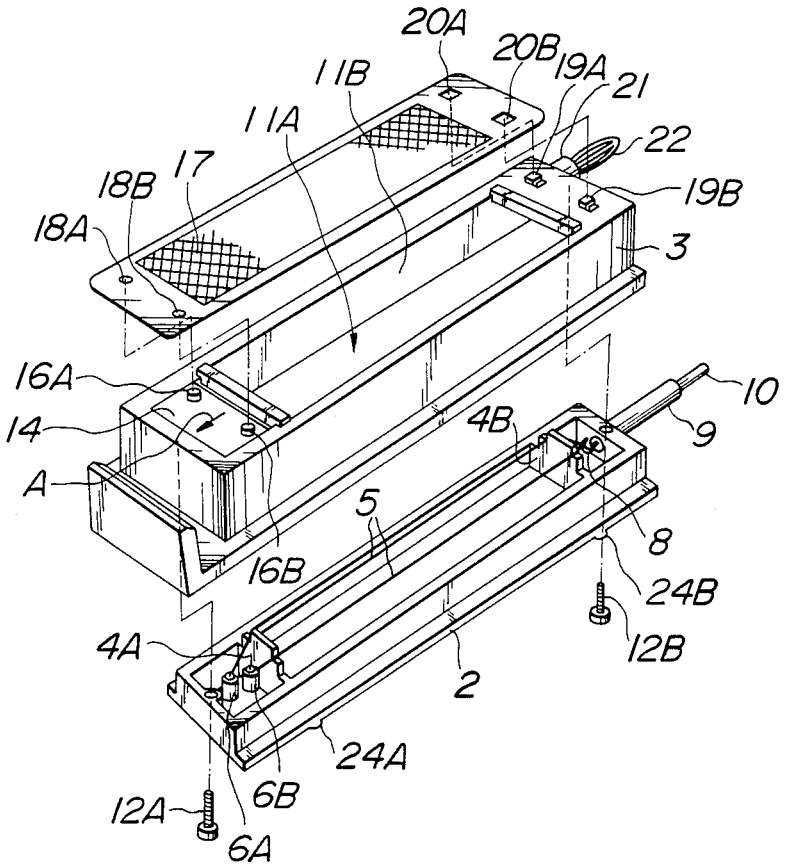
FIG. 2 is an exploded perspective view of the corona charger illustrated in FIG. 1.

FIG. 1 is a longitudinal cross section showing an embodiment of the corona charger according to the invention and FIG. 2 is an exploded perspective view thereof. According to the invention, the corona charger 1 comprises a base frame 2 and a grid frame 3 made of electrically insulating material. The grid frame 3 is detachably secured to the base frame 2. As clearly shown in FIG. 2, the base frame 2 is formed substantially as an elongated plate and the grid frame 3 is formed substantially as a box without top and bottom walls. In the base frame 2 are integrally formed a pair of bridge members 4A and 4B for supporting a corona wire 5. One end of the corona wire 5 is secured to the base frame 2 by means of a screw 6A. Then the wire 5 is extended over the bridge members 4A and 4B and is engaged with a hook 8 secured to the base frame 2. The corona wire 5 is further extended over the bridge members 4B and 4A and finally the other end of the wire is secured to the base frame 2 by means of a screw 6B. The hook 8 is made of electrically conductive and resilient material. Therefore, the corona wire 5 is stretched out resiliently over the bridge members 4A and 4B with a suitable tension. The hook 8 is electrically connected to a conductor 10 of a terminal 9 which may be connected to a corona voltage supply source.

The grid frame 3 has an internal space 11A which can accommodate a substantial part of the base frame 2 and an opening 11B. The grid frame 3 can be detachably fixed to the base frame 2 by means of a pair of screws 12A and 12B. At one end of the grid frame 3 there is provided a slide plate 14 which can be slidably moved in a longitudinal direction. The slide plate 14 is biased in a direction A by means of a coiled spring 15. On the upper surface of the slide plate 14 are formed a pair of pins 16A and 16B which can be inserted into corresponding holes 18A and 18B formed in a control grid 17 at its one end. The control grid 17 is formed by etching a very thin metal sheet having a thickness of about 0.05 to 0.1 mm. At the other end of the control grid 17 are also formed a pair of rectangular openings 20A and 20B and a conductor member 19 having a pair of projections 19A and 19B is secured to the grid frame 3. The projections 19A and 19B are insertable into the openings 20A and 20B. In this manner, the control grid 17 is detachably secured to the grid frame 3 and is resiliently stretched over the opening 11B. The conductor member 19 is electrically connected to a conductor 22 of a terminal 21 which may be connected to a control grid voltage supply source.

In the present embodiment, the corona wire 5 is detachably secured to the base frame 2. The control grid 17 is also detachably secured to the grid frame 3 and the grid frame 3 is secured to the base frame 2 in an easily removable manner. Therefore, the control grid 17 can be cleaned or replaced without removing the grid frame 3 from the base frame 2. Further, the corona wire 5 can be cleaned or replaced by simply removing the grid frame 3 from the base frame 2, while the control grid 17 remains on the grid frame 3. Moreover, since the corona wire 5 is supported resiliently by means of the resilient hook 8 and the control grid 17 is supported resiliently by means of the coiled spring 15, any difference in the thermal expansion between the corona wire 5, base frame 2, grid frame 3 and control grid 17 can be effectively compensated for. In this manner, the cut-off or hang over of the corona wire and control grid can be prevented and the desired electrification is always attained.

Figure 3:
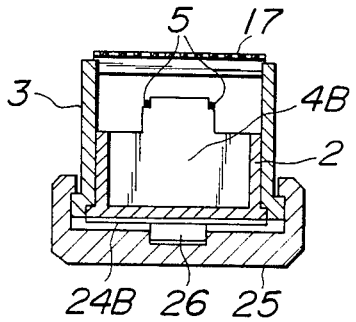
FIG. 3 is a transverse cross sectional view of the corona charger shown in FIG. 1.

FIG. 3 is a transverse cross section showing a way of securing the corona charger to an electrophotographic copying machine. The base frame 2 has a pair of ribs 24A and 24B formed in its bottom surface. To the machine is secured a guide 25 into which the corona charger 1 is insertable. On the inner surface of the guide 25 are provided a pair of leaf springs 26 which engage with the ribs 24A and 24B, when the corona charger is completely inserted into the guide 25. In this manner, the corona charger is held in the guide 25, while the corona charger is urged against the guide 25.

It should be noted that the present invention is not limited to the embodiment explained above, but may be modified in various ways. For instance, the coiled spring 15 may be replaced by a sponge piece and the slide plate 14 may be biased in the direction A by means of the resilient force of the sponge. Further, the slide plate 14 may be omitted. In such a case, the control grid 17 is detachably secured to the grid frame by means of a coiled spring provided between the grid frame and control grid. Moreover, the control grid may be formed by an array of wires. Further, in the above embodiment, the control grid is detachably secured to the grid frame, but it may be fixed to the grid frame by means of screws or any other suitable fixing means.

As explained above in detail, according to the invention, since the corona wire and control grid are secured to the base frame and grid frame, respectively, and these frames are secured to each other in an easily removable manner, the cleaning and replacement of the corona wire and control grid can be effected in an easy and rapid manner.

What is claimed is:

1. A corona charger of the scorotron type comprising a base frame;

a corona wire secured to the base frame;

a grid frame secured to the base frame in an easily removable manner;

a control grid removably secured to the grid frame and in insulated relationship to said corona wire; and resilient means for resiliently supporting the control grid over the opening of the grid frame to maintain the control grid under tension.

2. A corona charger according to claim 1, wherein said corona wire is detachably secured to the base frame.

3. A corona charger according to claim 1, wherein said grid frame is so constructed that it can be removed from the base frame, while the control grid remains secured to the grid frame.

4. A corona charger according to claim 3, wherein the grid frame is formed substantially as a box without top and bottom walls and having a top opening, and the control grid is stretched over the top opening of the box-like grid frame.

5. A corona charger according to claim 1, wherein said supporting means comprises a slide plate secured movably to the grid frame at its one end, movable stopper means provided on the slide plate, a spring member for biasing the slide plate outwardly in a longitudinal direction of the grid frame, and fixed stopper means provided on the grid frame at its other end, and said control grid has openings at opposite ends for engaging with said movable and fixed stopper means, respectively.

6. A corona charger according to claim 5, wherein said fixed stopper means is formed by electrically conductive material and is electrically connected to a terminal which may be connected to a control grid voltage supply source.

7. A corona charger according to claim 1, wherein said base frame and grid frame are made of electrically insulating material.

8. A corona charger of the scorotron type comprising:

a frame member having an opening;

a corona wire positioned within the frame member for radiating corona ions through the opening of the frame member;

a control grid member comprising a thin metal sheet having a number of fine apertures formed therein by etching and at least one opening formed in the metal sheet at respective opposite ends thereof;

a stationary fixing member comprising at least one pin-like member and fixed to the frame member, said pin-like member being insertable into at least one hole formed in said metal sheet at one end thereof;

a movable fixing member comprising at least one pin-like member which is insertable into at least one hole formed in said metal sheet at the other end thereof and slidably secured to the frame member;

a resilient member provided between the frame member and the movable fixing member for biasing the movable fixing member in a direction away from the stationary fixing member;

said control grid member supported within the opening in said frame member by said stationary and said movable members and in spaced relationship to said corona wire.

9. A corona charger according to claim 8, wherein said frame member includes a grid frame having opposed side and end walls, and opposed openings defined by said opposed side and end walls, and a base frame removably positioned in one of said opposed openings.

10. A corona charger according to claim 9, wherein said corona wire is carried by said base frame.

11. A corona charger according to claim 9, wherein said stationary fixing member and said movable fixing member are adjacent the other of said opposed openings.

12. A corona charger according to claim 8, wherein said resilient member is a spring.

13. A corona charger according to claim 8, wherein said control grid member includes two openings at each of one pair of opposite ends thereof and spaced outwardly of the fine apertures formed in said sheet.

* * * * *